US007518434B1

(12) United States Patent
Jurasek et al.

(10) Patent No.: US 7,518,434 B1
(45) Date of Patent: Apr. 14, 2009

(54) REFERENCE VOLTAGE CIRCUIT

(75) Inventors: Ryan Jurasek, Underhill, VT (US); Adam B. Wilson, Burlington, VT (US)

(73) Assignee: Cypress Semiconductor Corporation, San Jose, CA (US)

( * ) Notice: Subject to any disclaimer, the term of this patent is extended or adjusted under 35 U.S.C. 154(b) by 8 days.

(21) Appl. No.: 11/523,122

(22) Filed: Sep. 18, 2006

Related U.S. Application Data

(60) Provisional application No. 60/717,943, filed on Sep. 16, 2005.

(51) Int. Cl.
*G05F 1/10* (2006.01)

(52) U.S. Cl. ..... 327/538

(58) Field of Classification Search ..... 327/308, 327/403, 404, 405, 538, 543
See application file for complete search history.

(56) References Cited

U.S. PATENT DOCUMENTS 5,254,883 A * 10/1993 Horowitz et al. ..... 326/30
6,281,744 B1 * 8/2001 Kang ..... 327/541
6,456,139 B1 * 9/2002 Pelissier et al. ..... 327/322
6,744,302 B2 * 6/2004 Oikawa et al. ..... 327/538
6,922,098 B2 * 7/2005 Choi et al. ..... 327/538
7,142,044 B2 * 11/2006 Sano ..... 327/540
7,248,531 B2 * 7/2007 Pyeon et al. ..... 365/226
7,250,811 B2 * 7/2007 Kim ..... 327/538
7,282,989 B2 * 10/2007 Byeon ..... 327/541
7,289,377 B2 * 10/2007 Do ..... 365/189.09
7,319,361 B2 * 1/2008 Jin ..... 327/543

OTHER PUBLICATIONS

Paul R. Gray, Robert G. Meyer, "Analysis and Design of Analog Integrated Circuits", Third Edition, Copyright © 1977, 1984, 1993 by John Wiley & Songs, Inc., Chapter 4, section A4.2 Supply-Independent Biasing, pp. 322-333, Copy of book cover and Table of Contents included.

* cited by examiner

*Primary Examiner*—Jeffrey S Zweizig

(57) ABSTRACT

A method and apparatus for power supply rejection in a reference voltage circuit using a variable resistance circuit.

13 Claims, 9 Drawing Sheets

REFERENCE VOLTAGE CIRCUIT

RELATED APPLICATIONS

The present application claims the benefit of U.S. Provisional Application No. 60/717,943, filed Sep. 16, 2005.

TECHNICAL FIELD

The present invention relates generally to a reference voltage circuit and, more particularly, to power supply rejection in a reference voltage circuit.

BACKGROUND

Power Supply Rejection (PSR) is a design concern in electronic systems with a power supply distribution network. Circuits in an electronic system are typically located some distance from the system's power supply, where long lines may be used to distribute power to a collection of circuits. This type of power distribution network introduces voltage drops at the local power supply of circuits when current pulses are drawn from the power distribution line. Logic circuits commonly draw very fast current spikes from the power distribution system because they switch rapidly and drive capacitive loads. Since local power supply voltage drops disturb circuit operation, an increase in PSR is desirable.

FIG. 1 illustrates a conventional reference voltage circuit 100. In order to increase the PSR of the reference voltage circuit 100, a filter circuit 130 is coupled to and an output 111 of the reference voltage circuit 110. The input 131 of the filter circuit 130 is coupled to the output 111 of the reference voltage circuit 110 via line 120. Although the Although the filter circuit 130 suppresses noise in the desired frequency range, it does so at the expense of the reference system 100 incurring increased start-up times. Adjustments of circuit parameters in the circuit design can be made to these conventional circuits to decrease the start-up time, but these design adjustments affect the power efficiency of the reference voltage circuit. That is, a reference voltage circuit that consumes an excess amount of current may lead to a decrease in battery life in a battery-powered system, and may also require a cooling system to reduce the internal temperature of the circuit. Conventional designs, such as the one described above, that use low current, such as less than 10 uA (micro amps), may be used in slower starting reference circuits. Since, the current level restricts the start-up time, too low of current may restrict the start-up time so much that the reference voltage circuit does not power up in the desired time. For example, the startup-time may exceed 100 microseconds (us) when used in a PSRAM memory system. One type of conventional design that uses low current may be a bandgap reference circuit.

In another conventional method, the implementation of circuit changes improves the start-up time of a reference voltage circuit, but these changes are compromised by tradeoffs in performance characteristics of the circuit.

Another conventional method to increase the PSR of a reference circuit involves the addition of circuits to an existing reference voltage circuit design. This method requires not only a different circuit topology, but also additional voltage headroom for operation of the reference voltage circuit. The additional voltage headroom required for this type of method is limited by the circuit's voltage range, which is limited by the power supply.

BRIEF DESCRIPTION OF THE DRAWINGS

The present invention is illustrated by way of example, and not by way of limitation, in the figures of the accompanying drawings in which.

DETAILED DESCRIPTION

In the following description, for purposes of explanation, numerous specific details are set forth in order to provide a thorough understanding of the present invention. It will be evident, however, to one skilled in the art that the present invention may be practiced without these specific details. In other instances, well-known circuits, structures, and techniques are not shown in detail, but rather in a block diagram in order to avoid unnecessarily obscuring an understanding of this description.

Reference in the description to "one embodiment" or "an embodiment" means that a particular feature, structure, or characteristic described in connection with the embodiment is included in at least one embodiment of the invention. The phrase "in one embodiment" located in various places in this description does not necessarily refer to the same embodiment.

In one embodiment, the methods and apparatus described herein may be used with memory devices such as dynamic random access memory (DRAM) and pseudo-static random access memory (PSRAM). Alternatively, the methods and apparatus described herein may be used with other types of devices.

Figure 1:
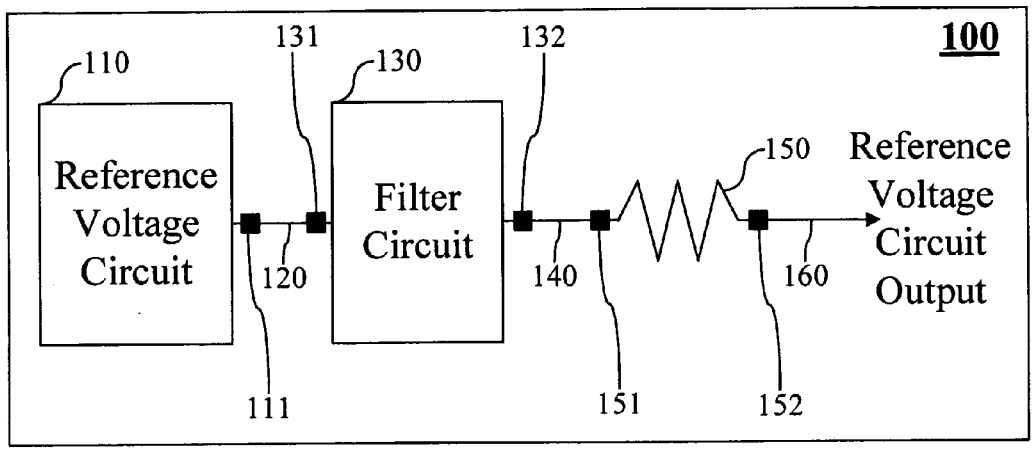
FIG. 1 (Prior Art)
FIG. 1 illustrates a conventional reference voltage circuit system having a filter circuit.
Figure 2:
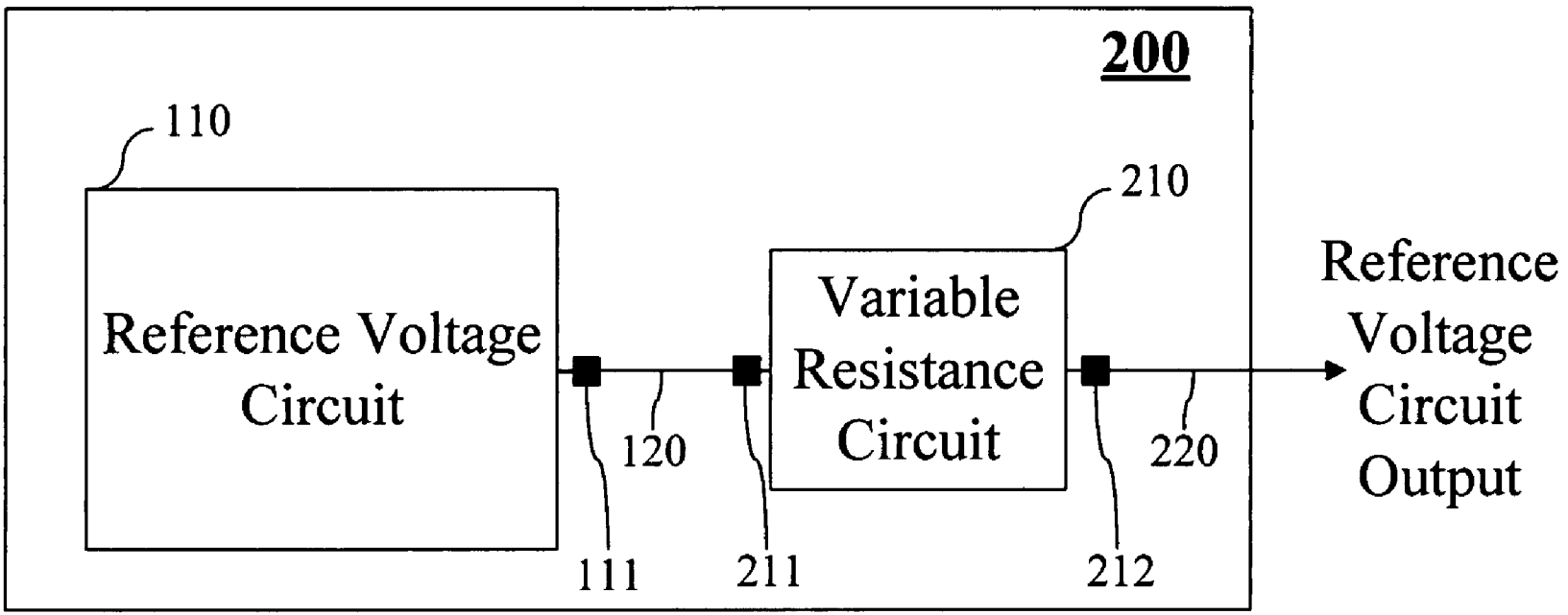
FIG. 2 illustrates one embodiment of a reference voltage circuit having a variable resistance circuit.

FIG. 2 illustrates one embodiment of a reference voltage circuit 200. The reference voltage circuit 200 includes a reference voltage circuit 110 and a variable resistance circuit 210. The input 211 of the variable resistance circuit 210 is coupled to the output 111 of the reference voltage circuit 111. An example of the reference voltage circuit 110 may be a bandgap reference circuit, which is known by those of ordinary skill in the art; accordingly, a more detailed description is not provided. Alternatively, other types of alternate reference voltage circuits may be used, for example, an on-chip voltage derived from a node in the electronic system implementing the reference voltage circuit 110, a charge-pump with a voltage regulation circuit, or the like. The variable resistance circuit 210 adjusts the output load of the reference voltage circuit 110, such that a predetermined level of power supply rejection for the reference voltage circuit 110 is achieved. For example, the predetermined level of power supply rejection may be set at negative 20 dB when used in a PSRAM memory system. Alternatively, other levels of power supply rejection and systems may be used. Further, the variable resistance circuit 210 may also be used to decrease start-up time of the reference voltage circuit 200.

In one embodiment, the reference voltage circuit is turned off after power-up so it can operate at a higher current, such as greater than 10 uA and have a better power-up response, such as greater than 100 us start-up time. The higher current allows the circuit to meet the power-up time. This increased current might prohibit the circuit from meeting the standby current specification, which is why the reference voltage reference circuit is turned off. It should be noted that the values provided above may be for use of the reference voltage circuit as used in a PSRAM memory system. It should be noted that these values, which depend on the design specifications, may vary, and the reference voltage circuit may be used in other systems other than PSRAM memory systems.

Figure 3:
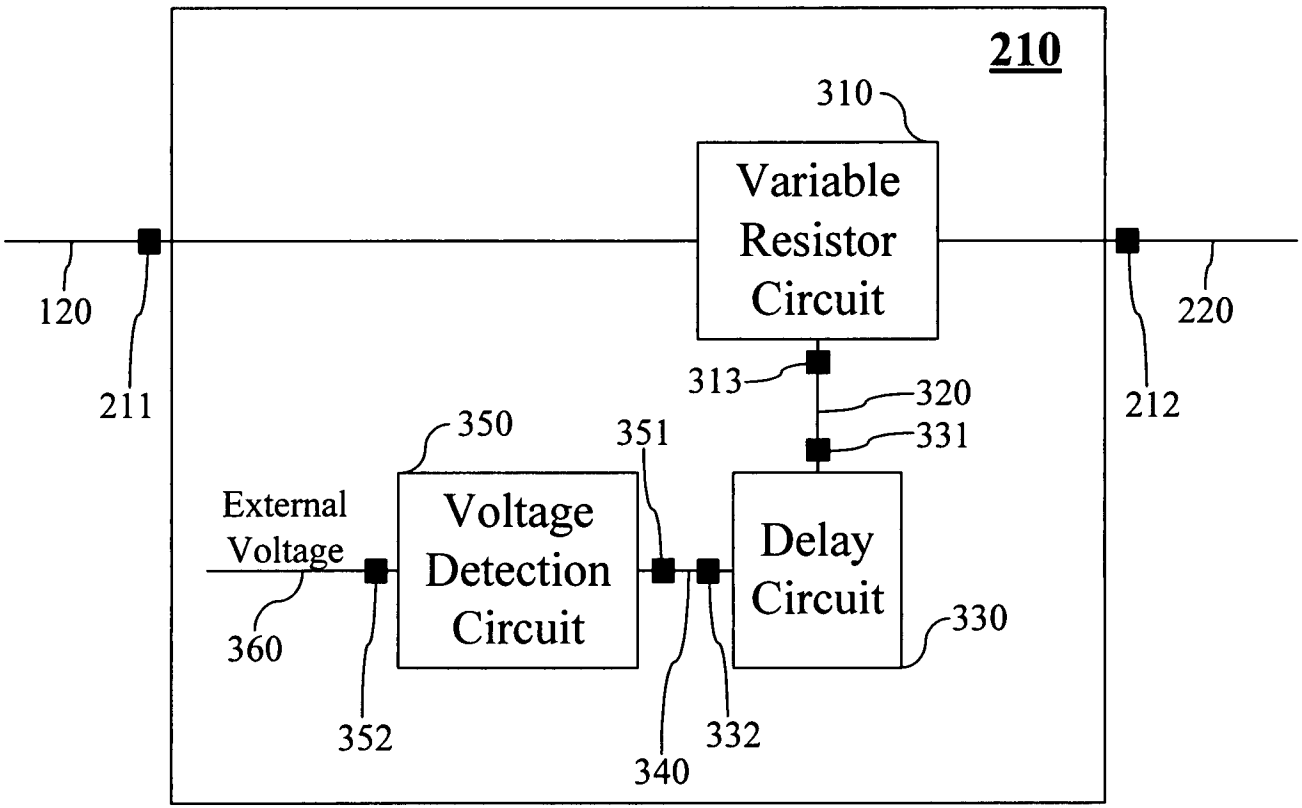
FIG. 3 illustrates one embodiment of a variable resistance circuit.

In one embodiment, the variable resistance circuit 210 includes a variable resistor circuit 310, a delay circuit 330, a voltage detection circuit 350, and an external voltage 360, as illustrated in FIG. 3. An example of the variable resistor circuit 310 is a potentiometer, which provides a plurality of resistance values. A potentiometer is known in the art; accordingly, a more detailed description is not provided. Alternatively, other types of variable resistor circuits may be used, for example, rheostats, varistors, photoresistors, etc. One input 313 of the variable resistor circuit 310 is coupled to the output 331 of the delay circuit 330 via line 320. In one embodiment, the delay circuit 330 includes one delay element. Alternatively, the delay circuit 330 includes one or more delay elements.

An input 332 of the delay circuit 330 is coupled to an output 351 of the voltage detection circuit 350. One embodiment of the voltage detection circuit 350 includes an electronic comparator circuit, where a first input of the electronic comparator circuit is coupled to an output (e.g., 111) of the reference voltage circuit 110 and a second input 352 is coupled to an external reference voltage 360. The input of the electronic comparator circuit, which is coupled to the output of the reference voltage circuit, may be coupled to an internal node in the reference voltage circuit 10. The external reference voltage 360 may be coupled to a node in an electronic system implementing the reference voltage circuit 110. The voltage detection circuit 350 detects when the output of the reference voltage circuit 120 reaches a predetermined voltage level via the voltage levels of the first and second inputs of the electronic comparator circuit.

To further provide an understanding of the operation of the present invention, two exemplary modes of operation will be discussed: steady-state and start-up modes of operation. The apparatus of the present invention, however, is not limited to these exemplary modes of operation. Due to external factors, such as an unstable power supply coupled to the reference voltage circuit 110, the output 111 of the reference voltage circuit 110 may be at a voltage level inconsistent with steady-state operation. In this scenario, the voltage detection circuit 350 detects that the reference voltage circuit 110 is not in steady-state operation using the electronic comparator circuit. The variable resistor circuit 310, in response, may increase the resistance value at the output 111 of the reference voltage circuit 110 in order to achieve a predetermined level of power supply rejection. The delay circuit 330 may be used to tune the output 212 of the variable resistance circuit 210. For instance, the delay circuit 330 may be used to tune the transition from one resistance value to another resistance value. In effect, the variable resistor circuit 310 may be used to set the time to transition to steady-state from power-up.

The variable resistance circuit 210 may also be used for start-up mode of operation for the reference voltage circuit 110. For instance, the voltage detection circuit 350 may detect the output 111 of the reference voltage circuit 110 to be at a predetermined voltage level commensurate with a start-up mode of operation. The variable resistor circuit 310, in response, may decrease the resistance value at the output 111 of the reference voltage circuit 110. The decrease in resistance value at the output 111 of the reference voltage circuit 110 may optimize the transient response of the reference voltage circuit 110, such that the reference voltage circuit output 212 on line 220 reaches a steady-state voltage level more quickly than conventional designs, which consequently improves the start-up time of the reference voltage circuit 110. For example, using the decrease in resistance value using the variable resistor circuit 310, the start-up time may be less than 100 microseconds (us) when used in a PSRAM memory system. Alternatively, other start-up times and systems may be used. Similar to above, the delay circuit 330 may be used to tune the output 212 of the variable resistor circuit 310.

Figure 4:
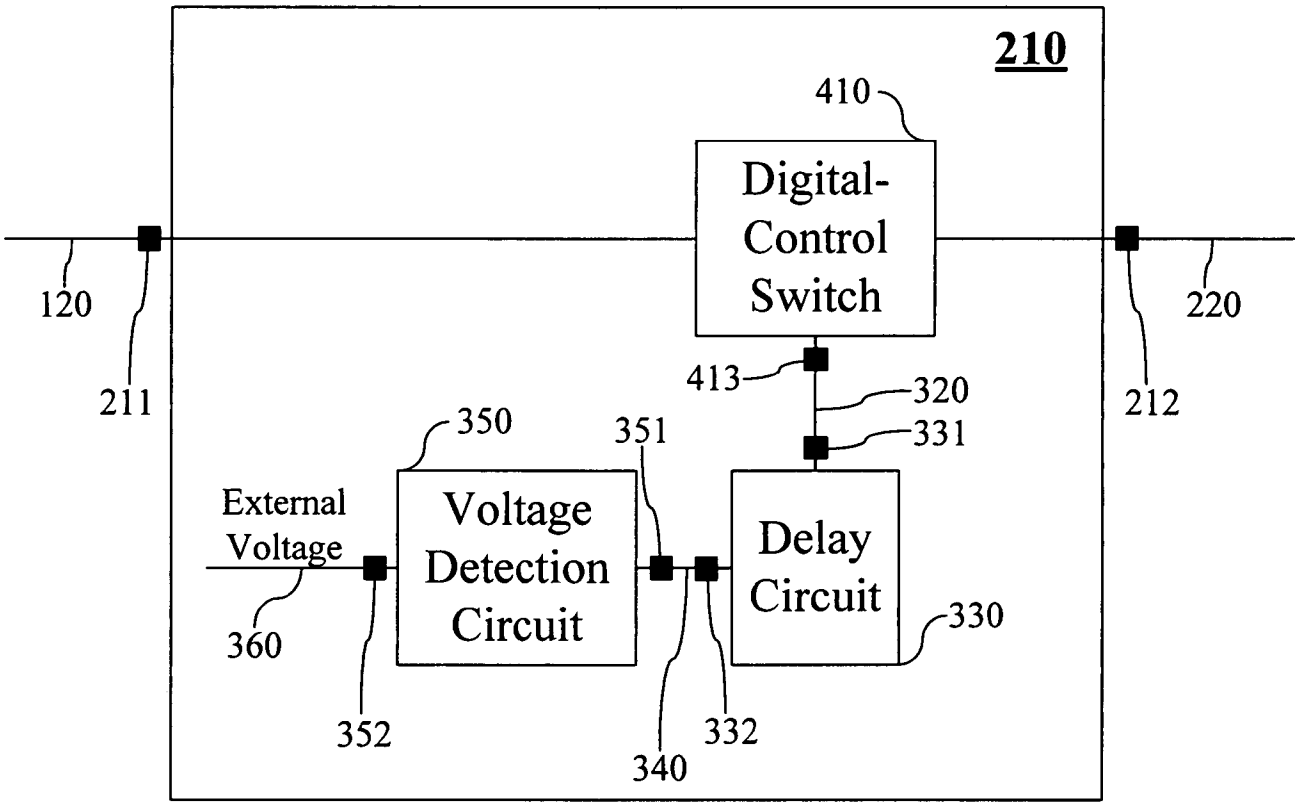
FIG. 4 illustrates an alternate embodiment of a variable resistance circuit.

FIG. 4 illustrates the variable resistance circuit 210 according to another embodiment of the present invention. In this embodiment, the variable resistance circuit 210 includes a digital-control switch 410, a delay circuit 330, and a voltage detection circuit 350. An input 211 of the digital-control switch 410 is coupled to an output 111 of the reference voltage circuit 110. Another input 413 of the digital-control switch 410 is coupled to an output 331 of the delay circuit 330. An input 332 of the delay circuit 330 is coupled to an output 351 of the voltage detection circuit 350. An external voltage 360 is coupled to an input 352 of the voltage detection circuit 350. In one embodiment, the external voltage 360 may be coupled to a node in an electronic system implementing the reference voltage circuit 110. Alternatively, the external voltage 360 may be coupled to an internal node in the reference voltage circuit 110. The voltage detection circuit 350 and delay circuit 330 operate in a similar manner as described above (i.e., the embodiment of the present invention illustrated in FIG. 3).

Figure 5:
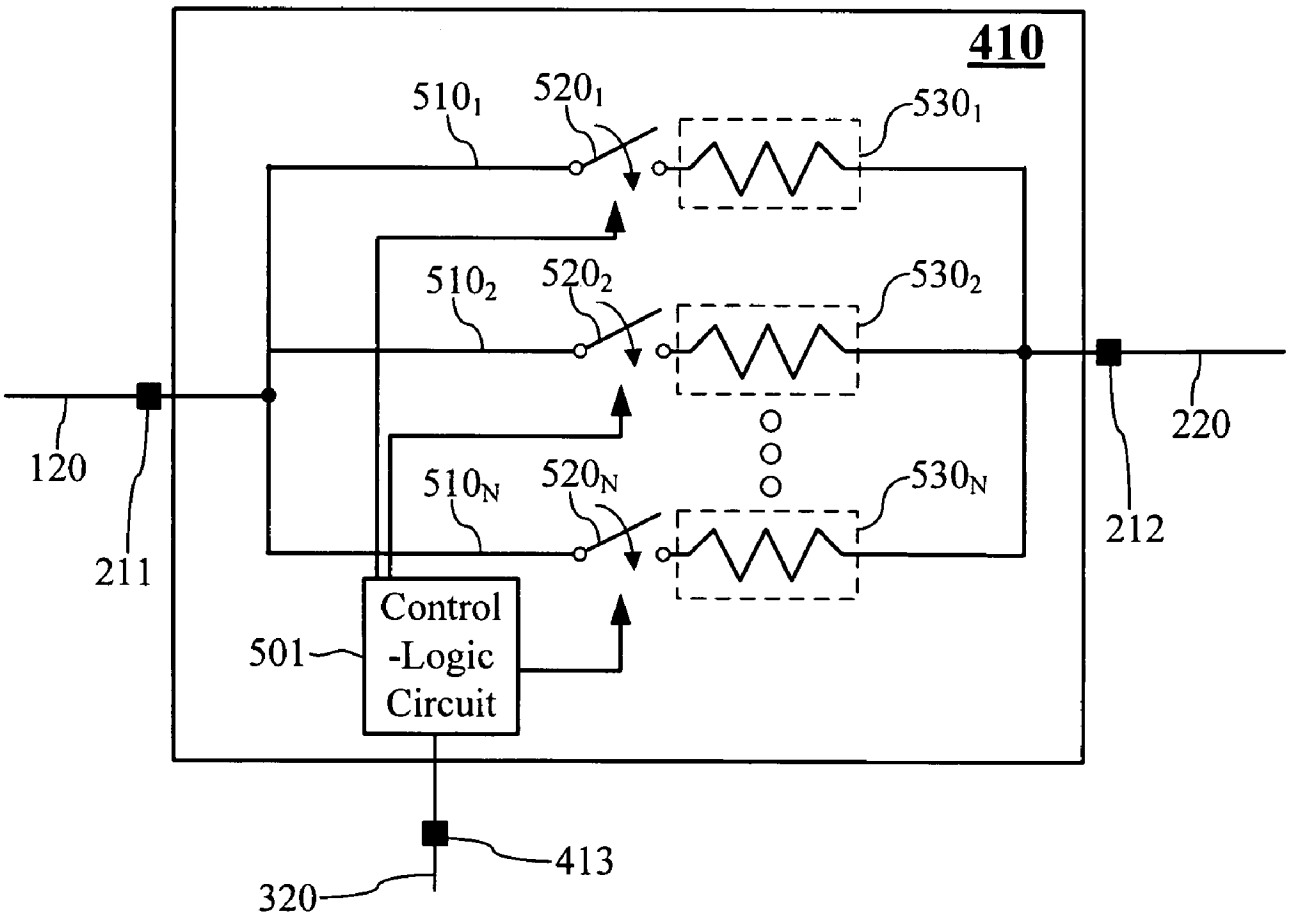
FIG. 5 illustrates one embodiment of a digital-control switch.

The digital-control switch 410 controls the resistance values at the output 111 of the reference voltage circuit 110. In one embodiment, the digital-control switch 410 includes a control-logic circuit 501, a plurality of switches $\mathbf{520}_1$-$\mathbf{520}_N$, and a plurality of resistive elements $\mathbf{530}_1$-$\mathbf{530}_N$, as illustrated in FIG. 5. In one embodiment, an input of one resistive element $\mathbf{530}_1$ is coupled to a switch $\mathbf{520}_1$ and the output of the same resistive element $\mathbf{530}_1$ is coupled to an output 212 of the digital-control switch 410. The plurality of outputs from the resistive elements $\mathbf{530}_1$-$\mathbf{530}_N$ share one common output, the output 212 of the digital-control switch 410.

Similar to the operation of the variable resistor circuit 310 described above, the control-logic circuit 501 of the digital-control switch 410 determines the resistance value at the output 111 of the reference voltage circuit 110 during the reference voltage circuit's steady-state and start-up modes of operation. In particular, the digital-control switch 410 may select a predetermined resistance value when the reference voltage circuit 110 operates outside of steady-state in order to increase power supply rejection. Likewise, the digital-control switch 410 may select a predetermined resistance value when the reference voltage circuit 110 operates in start-up mode, such that the transient response of the reference voltage circuit 110 is improved, resulting in a decrease in start-up time of the reference voltage circuit 110.

Figure 6:
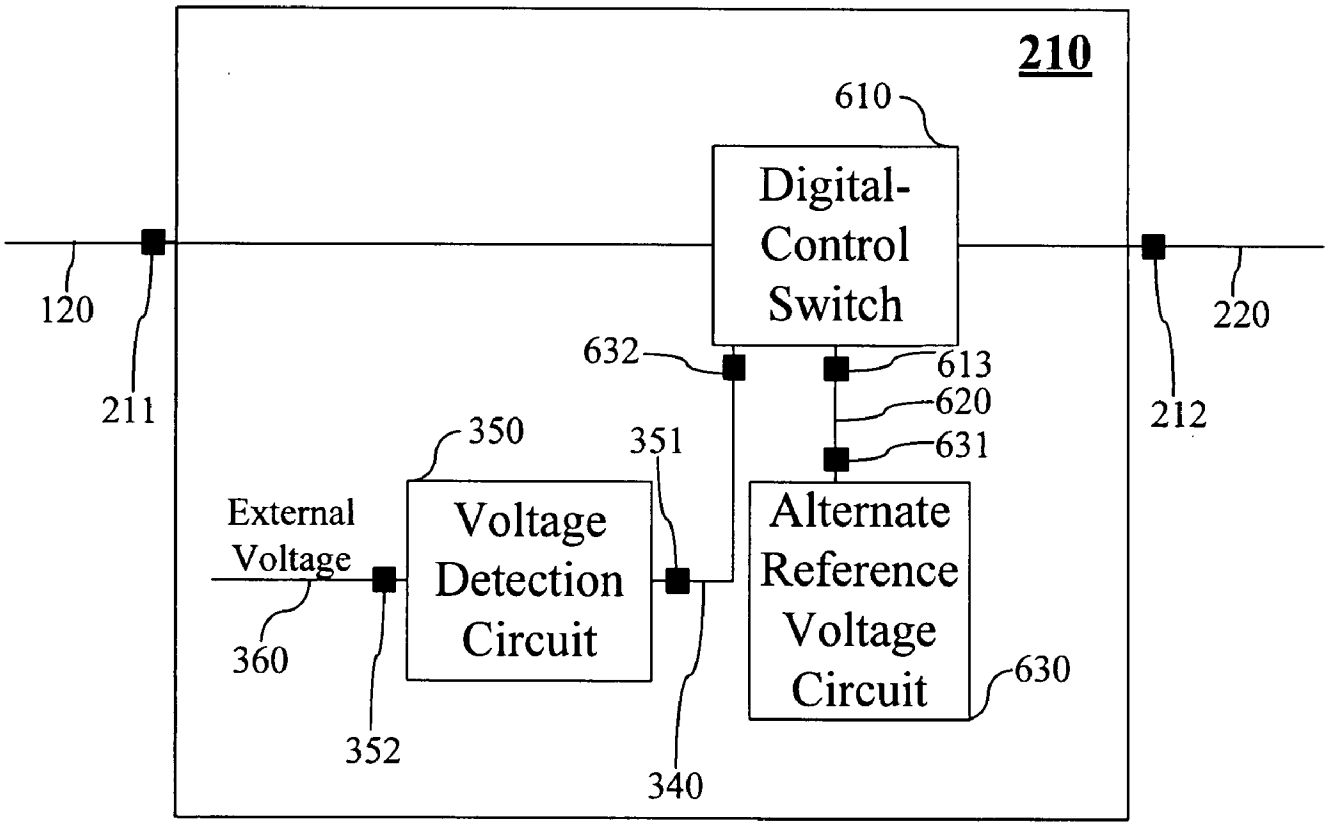
FIG. 6 illustrates an alternate embodiment of a variable resistance circuit having an alternate reference voltage circuit.

FIG. 6 illustrates the variable resistance circuit 210 according to another embodiment of the present invention. In this embodiment, the variable resistance circuit 210 includes a digital-control switch 610, an alternate reference voltage circuit 630, and a voltage detection circuit 350. An input 211 of the digital-control switch 610 is coupled to the output 111 of the reference voltage circuit 110. Another input 613 of the digital-control switch 610 is coupled to an output 631 of the alternate reference voltage circuit 630 on line 620. In one embodiment, the alternate reference voltage circuit 630 may be a bandgap reference circuit, which is known by those of ordinary skill in the art; accordingly, a more detailed description is not provided. In another embodiment, the alternate reference voltage circuit is a low impedance driver that can drive the bandgap reference node, or alternatively, use a dual switch to enable/disable the alternate reference to the net and disable/enable the bandgap reference. Alternatively, other types of alternate reference voltage circuits may be used, for example, an on-chip voltage derived from a node in the electronic system implementing the reference voltage circuit 110, a charge-pump with a voltage regulation circuit, or the like. An input 632 of the digital-control switch 610 is coupled to an output 351 of the voltage detection circuit 350 on line 340. An external voltage 360 is coupled to an input 352 of the voltage detection circuit 350. In one embodiment, the external voltage 360 may be coupled to a node in an electronic system implementing the reference voltage circuit 110. Alternatively, the external voltage 360 may be coupled to an internal node in the reference voltage circuit 110. The voltage detection circuit 350 operates in a similar manner as described above (i.e., the embodiment of the present invention illustrated in FIG. 3).

Figure 7:
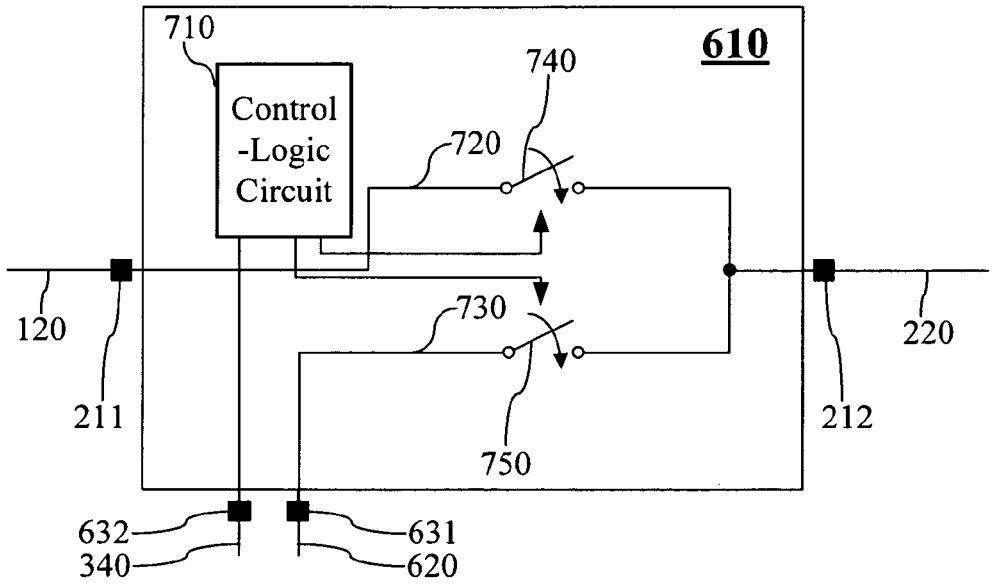
FIG. 7 illustrates an alternate embodiment of a digital-control switch.

The digital-control switch 610 controls the resistance values at the output 111 of the reference voltage circuit 110. In one embodiment, the digital-control switch 610 includes a control-logic circuit 710 and a plurality of digitally-controlled switches. In another embodiment, the digital-control switch 610 may have two digitally-controlled switches 740 and 750, as illustrated in FIG. 7. Through the control-logic circuit 710, switch 740 may be coupled to the output 111 of the reference voltage circuit 110 and switch 750 may be coupled to an output 631 of the alternate reference voltage circuit 630 on line 620. In this embodiment of the present invention, the operation of the digital-control switch 610 will be discussed, for exemplary purposes, in terms of steady-state and start-up modes of operations, however, alternative embodiments, may be implemented in other modes of operations.

To increase the power supply rejection of the reference voltage circuit 110, the alternate reference voltage circuit 630 may be coupled to the reference voltage circuit output 212 via the digital-control switch 610. For instance, the voltage detection circuit 350 detects when the reference voltage circuit 110 operates outside of steady-state mode. This voltage detection may be performed using an electronic comparator circuit, where an input of the electronic comparator circuit may be coupled to an external voltage 360 and another input may be coupled to a node in the reference voltage circuit 110. The function of the electronic comparator circuit in the voltage detection circuit 350 is similar to the comparator of other embodiments described above. That is, once a predetermined voltage level is reached, the voltage detection circuit 350 activates the digital-control switch 610 to couple the alternate reference voltage circuit 630 to the output 212 of the reference voltage reference voltage circuit 210. The alternate reference voltage circuit 630 maintains a stable voltage level at the reference voltage circuit output 212, independent of variances in the power supply. A delay circuit may be used in the control-logic circuit 710 to tune the transition between the output 111 of the reference voltage circuit 110 and output 631 of the alternate voltage reference circuit 630 at the reference voltage circuit output 212.

In the start-up mode of operation, the alternate reference voltage circuit 630 is coupled to the reference voltage circuit output 212, until the reference voltage circuit 110 reaches a predetermined voltage level. While the alternate reference voltage circuit 630 is coupled to the reference voltage circuit output 212, the reference voltage circuit 110 is decoupled from the reference voltage circuit output 212 through the digital-control switch 610. The transient response and the start-up time of the reference voltage circuit 110 are improved since the reference voltage circuit 110 does not drive the output load of the reference voltage circuit during the start-up mode of operation. This output load is driven by the alternate reference voltage circuit 630. Once the voltage detection circuit 350 detects that a predetermined voltage level has been reached (e.g., a voltage level commensurate to steady-state operation), the digital-control switch 610 decouples the alternate reference voltage circuit 630 from the reference voltage circuit output 212 and couples the reference voltage circuit 110 onto the reference voltage circuit output 212.

Figure 8:
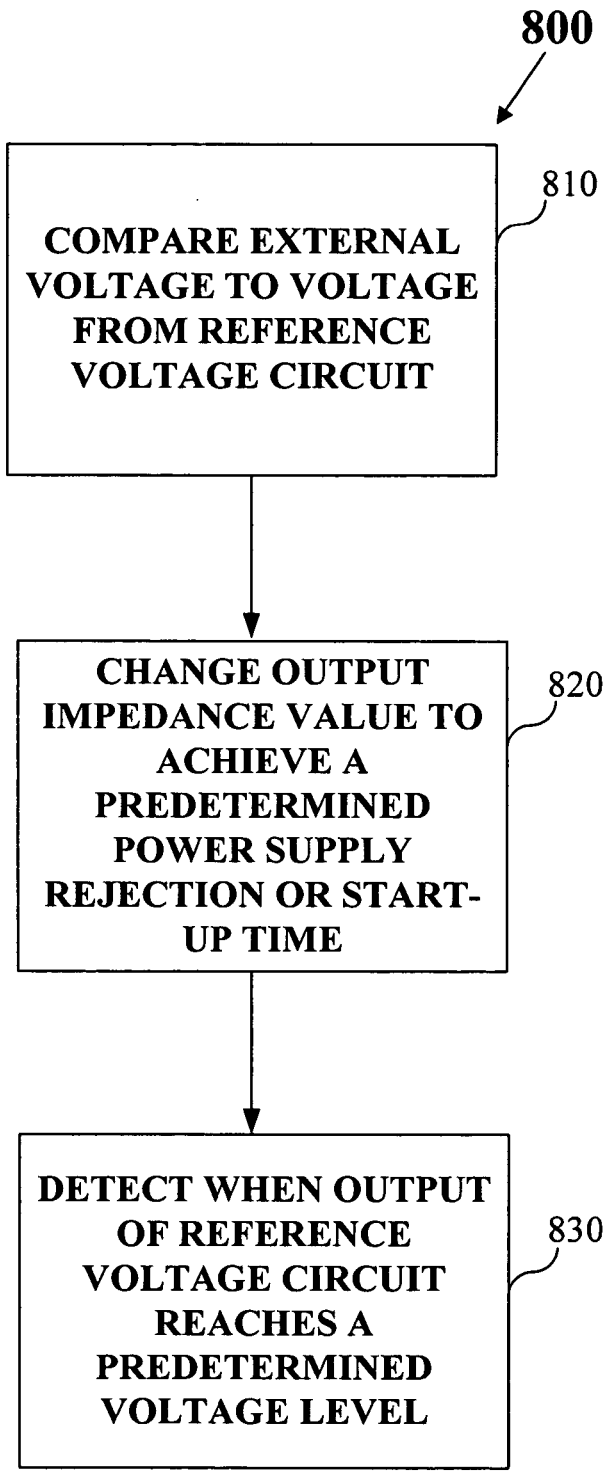
FIG. 8 illustrates one embodiment of a method of achieving a predetermined level of power supply rejection and start-up time for a reference voltage circuit.

FIG. 8 illustrates one embodiment of a method to achieve a predetermined level of power supply rejection or start-up time for the reference voltage circuit 110. In operation 810, an external voltage 360 is compared to a voltage from the reference voltage circuit 110. The comparison of these two voltages is used to determine the output impedance value, as described in the following operation. In operation 820, the output the output impedance value of the reference voltage circuit 110 is changed to a value commensurate to a predetermined level of power supply rejection or start-up time for the reference voltage circuit 110. To change the output impedance value, the method may include switching the output impedance value of the reference voltage circuit to an alternate output impedance value. In operation 830, the voltage detection circuit 350 detects when the output 111 of the reference voltage circuit 110 reaches a predetermined voltage level. In one embodiment, similar to operation 810, the detection of when the output 111 of the reference voltage circuit 110 reaches a predetermined voltage level includes comparing an external voltage 360 to a voltage from the reference voltage circuit 110. In one embodiment, an electronic comparator circuit may be used to compare the two aforementioned voltages. The comparison of the two voltages may be used to set the output impedance value of the reference voltage circuit 110 in order to achieve an optimal level of power supply rejection or start-up time for the reference voltage circuit 110.

The reference voltage circuit 200, as discussed herein, may be used in various applications. In one embodiment, the reference voltage circuit 200 discussed herein may be used in connection with a memory device, such as DRAM or PSRAM. The reference voltage circuit 200 may provide a stable reference voltage for on-chip sensing circuits or cascaded circuit topologies. Alternatively, the reference voltage circuit 200 herein may be used in other types of applications, for example, microprocessors, radio-frequency integrated circuits, power management devices, etc.

Figure 9:
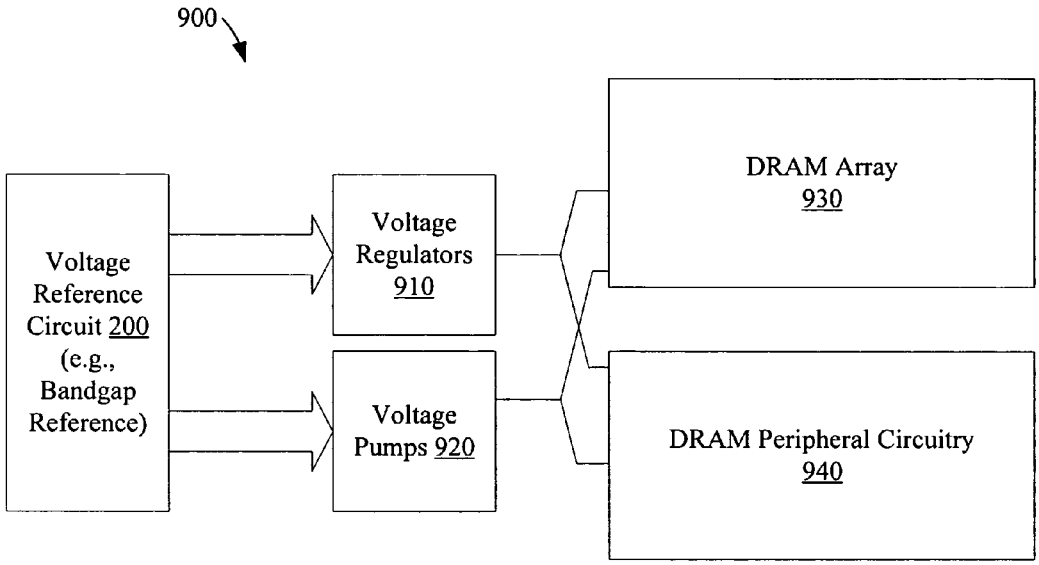
FIG. 9 illustrates one embodiment of a system implementing a reference voltage circuit having a variable resistance circuit.

FIG. 9 illustrates one embodiment of a DRAM memory system including a reference voltage circuit 200. Memory system 900 includes the reference voltage circuit 200, voltage regulators 910, voltage pumps 920, DRAM array 930, and DRAM peripheral circuitry 940. The voltage circuit 200 may be configured and may operate in a similar operate in a similar manner as the embodiments described above. In this embodiment, the reference voltage circuit is a bandgap reference circuit. Alternatively, other types of reference voltage circuits may be used. Similarly, although the present embodiment describes and illustrates a DRAM memory system, other systems may employ the reference voltage circuit, as described herein, such as a PSRAM memory system, or the like.

The bandgap circuit of FIG. 9 is coupled to the inputs to the voltage regulators 910 and the voltage pumps 920 of the memory system 900. Each of the outputs of the voltage regulators 910 and voltages pumps 920 are coupled to the DRAM array 930 and the DRAM peripheral circuitry 940. The DRAM peripheral circuitry 940 may include circuits, such as, for example, row and column decoders, sense amps, power-down circuitry, refresh circuitry, or the like. The voltage regulators 910, voltage pumps 920, DRAM array 930, and the DRAM peripheral circuitry 940 are known by those of ordinary skill in the art, and accordingly, a more detailed description of these components is not provided.

Although the specific invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative manner rather than a restrictive sense.

What is claimed is:

1. A method, comprising:

changing an output impedance value coupled to an output of a reference voltage circuit; and detecting when an output of the reference voltage circuit reaches a predetermined voltage level, wherein detecting when the output of the reference voltage circuit reaches the predetermined voltage level comprises comparing an external voltage to a voltage from the reference voltage circuit, wherein the comparison of the two voltages is used to set the output impedance value, and wherein changing the output impedance value comprises tuning the output of the variable resistance circuit using a delay circuit.

2. The method of claim 1, wherein changing the output impedance value comprises switching an output impedance value of the reference circuit to an alternate output impedance value.

3. An apparatus, comprising:

a reference voltage circuit having a first output; and a variable resistance circuit coupled to the first output of the reference voltage circuit, the variable resistance circuit to adjust an output load of the reference voltage circuit, wherein the variable resistance circuit comprises:

a voltage detection circuit to compare a voltage from the reference voltage circuit to an external reference voltage;

a delay circuit coupled to an output of the voltage detection circuit, the delay circuit to tune an output of the variable resistance circuit; and a variable resistor circuit comprising a plurality of resistance values coupled to an output of the delay circuit.

4. The apparatus of claim 3, wherein an output of the voltage detection circuit is coupled to an input of the delay circuit, the voltage detection circuit to activate the delay circuit.

5. The apparatus of claim 3, wherein an output of the delay circuit is coupled to an input of the circuit comprising a plurality of resistance values, the delay circuit comprising one or more delay elements, and the delay circuit to tune an output of the variable resistor circuit.

6. The apparatus of claim 3, the voltage detection circuit comprises:

an electronic comparator circuit having a first and second input;

the first input of the electronic comparator circuit coupled to a second output of the reference circuit; and the second input of the electronic comparator circuit coupled to the external reference voltage.

7. The apparatus of claim 6, wherein voltage levels of the first and second inputs of the electronic comparator circuit are used to determine an impedance value of the output load of the reference voltage circuit.

8. An apparatus, comprising:

a reference voltage circuit having a first output; and a variable resistance circuit coupled to the first output of the reference voltage circuit, the variable resistance circuit to adjust an output load of the reference voltage circuit, wherein the variable resistance circuit comprises:

a voltage detection circuit to compare a voltage from the reference voltage circuit to an external reference voltage;

a delay circuit coupled to an output of the voltage detection circuit, the delay circuit to tune an output of the variable resistance circuit; and a digital-control switch coupled to an output of the delay circuit.

9. The apparatus of claim 8, wherein the digital-control switch comprises:

a plurality of resistive elements coupled to a plurality of digitally-controlled switches; and a control-logic circuit to control the activation of the digitally-controlled switches.

10. The apparatus of claim 9, wherein the control-logic circuit couples the plurality of resistive elements to an output of the reference voltage circuit via the digitally-controlled switches, and wherein a resistive element is coupled to the output of the reference voltage circuit via the digitally-controlled switch in response to the output of the voltage detection circuit.

11. An apparatus, comprising:

means for adjusting an output load of a reference voltage circuit to achieve a predetermined level of power supply rejection for the reference voltage circuit; and means for detecting when an output of the reference voltage circuit reaches a predetermined voltage level, wherein the means for adjusting comprises:

means for comparing a voltage from the reference voltage circuit to an external reference voltage; and means for tuning an output of the means for adjusting the output load of the reference voltage circuit.

12. The apparatus of claim 11, wherein the means for adjusting the output load further comprises a means for optimizing for a transient response of the reference voltage reference circuit.

13. The apparatus of claim 11, wherein the wherein the means for adjusting the output load decreases start-up time of the reference voltage circuit.

* * * * *